US011845120B2

(12) United States Patent
Salihbegovic

(10) Patent No.: US 11,845,120 B2
(45) Date of Patent: Dec. 19, 2023

(54) BELLOW INTERNAL-EXTERNAL PRESSURE CRIMPING METHOD AND CRIMPING- COMPRESSING DEVICE

(71) Applicant: Zlatko Salihbegovic, New Iberia, LA (US)

(72) Inventor: Zlatko Salihbegovic, New Iberia, LA (US)

( * ) Notice: Subject to any disclaimer, the term of this patent is extended or adjusted under 35 U.S.C. 154(b) by 104 days.

(21) Appl. No.: 17/108,491

(22) Filed: Dec. 11, 2020

(65) Prior Publication Data

US 2021/0086248 A1 Mar. 25, 2021

(51) Int. Cl.
*B21D 15/02* (2006.01)

(52) U.S. Cl.
CPC ..... *B21D 15/02* (2013.01)

(58) Field of Classification Search
CPC ..... B21D 15/06; B21D 15/10; B21D 26/033; B21D 26/041; B21D 26/047; B21D 51/12; B21C 37/156; B21C 37/24
See application file for complete search history.

(56) References Cited

U.S. PATENT DOCUMENTS 6,564,606 B2 * 5/2003 Okada ..... B21D 15/10 29/454
2001/0039822 A1 * 11/2001 Minamidate ..... B21D 51/12 72/370.19

* cited by examiner

*Primary Examiner* — Debra M Sullivan
(74) *Attorney, Agent, or Firm* — Ingenium Patents LLC; Peter R. Kramer

(57) ABSTRACT

Bellows are devices used to compensate linear, thermal, or angular movement/expansion. In oil and gas industry bellows are used in gas lift valves as a slidable seal between two gases. Gas lift valves are used in process of oil artificial lift from wells. Bellows having very thin walls are not well suited for pressures higher than approximately 200 PSI. To withstand much higher pressures bellows are being crimped, process that compresses the bellow to shorter length which increases bellow mechanical toughness. This patent application refers to bellow crimping method that uses initially balanced internal and external pressure to crimp bellow to desired length and maintain perfect bellow elements-convolution Ω geometry using custom designed crimping device.

2 Claims, 5 Drawing Sheets

BELLOW INTERNAL-EXTERNAL PRESSURE CRIMPING METHOD AND CRIMPING- COMPRESSING DEVICE

BACKGROUND OF THE INVENTION

(1) Field of the Invention

Oil and gas, artificial gas lift systems. Current bellow crimping—compressing method performed in traditional way is a process where bellows in free length LF are welded/soldered against mating parts and exposed to high external pressure of approximately 5000 PSI, depending on material, size and type of bellow, with internal pressure at atmospheric value. Process is performed in appropriate fixture/device. This crimping process does not provide convolution wall support from inside. Bellow subassembly features internal stop where mating parts touch each other after external pressure is applied preventing bellow over compression. However, purpose of said internal stop pertains to bellow functionality in gas lift valve, expansion and compression limitations after crimping process. Existing crimping process as described above assumes that bellow is properly crimped-shortened which is not the case. Because internal stop engages prematurely at bellow length that is not sufficiently compressed to desired length LC and lack of internal bellow wall pressure support results in severely damaged bellow convolution shapes after crimping-compressing where bellow radiuses R are deformed. See FIG. 3 1 that shows deformed bellow cross section after crimping. This damage negatively affects bellow pressure rating, cycle life and causes premature failures. Another method is mechanical crimping wherein bellows are compressed to length LC by applying compression force inside appropriate device/fixture. Said method provides better as crimped bellow, however convolution geometry is somewhat deformed, OD convolution having slightly triangular shape because of lack of internal wall support and convolution radiuses are not kept in original shape. See FIG. 2 that shows bellow cross section after mechanical crimping. Typical bellow used in 1.5" nominal size gas lift valves has free length of 4", OD 1.170", ID 0.755" and is made from Monel 400 material. Bellows for gas lift valve applications are usually made from material used for spring manufacturing as Monel 400, Inconel 625 and Inconel 718 material that are corrosion resistant and have 3 plys/layers. Bellows can have one or more plys/layers. Plys for gas lift valve bellows are usually 0.005" thick. See FIG. 1 for reference.

(2) Description of Related Art Including Information Disclosed Under 37 CFR 1.97 and 1.98

Not applicable

BRIEF SUMMARY OF THE INVENTION

Bellows are mechanical devices used to compensate linear, thermal, or angular movement/expansion. Said bellows can be made in different shapes, sizes, using different materials. One typical example of bellows application is in pipelines to compensate for thermal expansion between solid supports. In oil and gas industry bellows are used as a slidable seal between two gases in gas lift valves. Gas lift valves are used in process of oil artificial lift from wells. Currently only two nominal bellows sizes are used in oil gas lift systems, 1.0" and 1.5". However, as manufactured bellows having very thin walls are not well suited for pressures higher than approximately 200 PSI depending on bellows type, size and material used. To withstand much higher pressures bellows are being crimped, method that compresses the bellow to shorter length which increases said bellow overall mechanical toughness. In addition, bellows in gas lift valves must be pressure balanced inside and outside as much as possible to withstand high pressures up to 2500 PSI. This patent application refers to free standing bellow crimping method that uses initially balanced internal and external pressure to crimp bellows to desired length and maintain perfect bellow elements-convolution Ω geometry. Applied internal pressure supports bellow/convolution wall internal surface preventing wall collapse. In another embodiment of this patent application bellows can be crimped after welding/soldering against mating parts in custom built device. If bellows are crimped while welded/soldered per said process/method against mating parts internal solid stop between mating parts is not used. This is made possible by using custom designed bellow crimping device described herein.

BRIEF DESCRIPTION OF THE SEVERAL VIEWS OF THE DRAWING(S)

DETAILED DESCRIPTION OF THE INVENTION

Bellows are devices used to compensate linear, thermal, or angular movement/expansion in different applications like pipelines that are exposed to temperature changes and thermal expansion. Bellows can be also used as actuators in different machinery applications. For this purpose, bellows are built from thin materials and have specific element/convolution shapes in form of radiuses R which allow for linear or angular movement/compensation. Different techniques are used for bellows manufacturing as rolling, hydraulic forming, chemical vapor deposition and 3D printing. In oil and gas industry bellows are used as a slidable seal between two gases in gas lift valves. Said gas lift valves are used in process of oil artificial lift from wells. Requirements for these bellows are to withstands high differential pressures, high cycle numbers, temperatures and to be sufficiently corrosion resistant. However, as manufactured bellows having very thin walls are not well suited for pressures higher than approximately 200 PSI depending on materials used, geometrical shapes and sizes. To increase bellow pressure rating bellows are crimped/compressed to reduce overall length. It is generally recommended by bellows manufacturers to compress bellows up to 70% of free length LF. Said crimping process increases bellow overall mechanical toughness. For bellows to work properly it is essential to maintain bellow element/convolution radiuses/geometry during crimping process.

Proposed Internal-External Pressure Below Crimping Method

Figure 1:
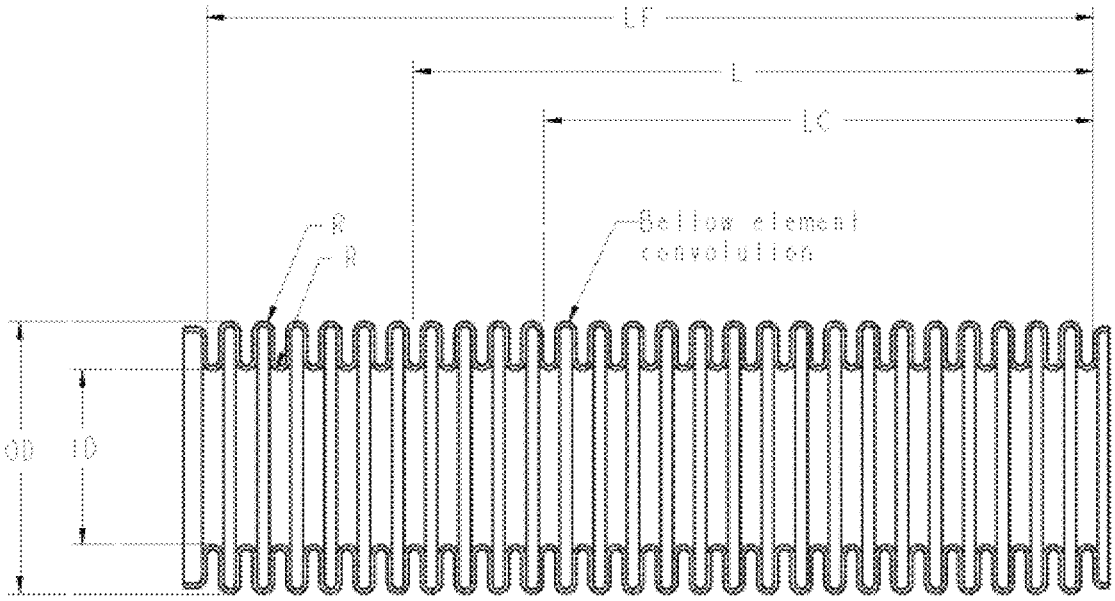
FIG. 1 shows general bellow geometry
Figure 2:
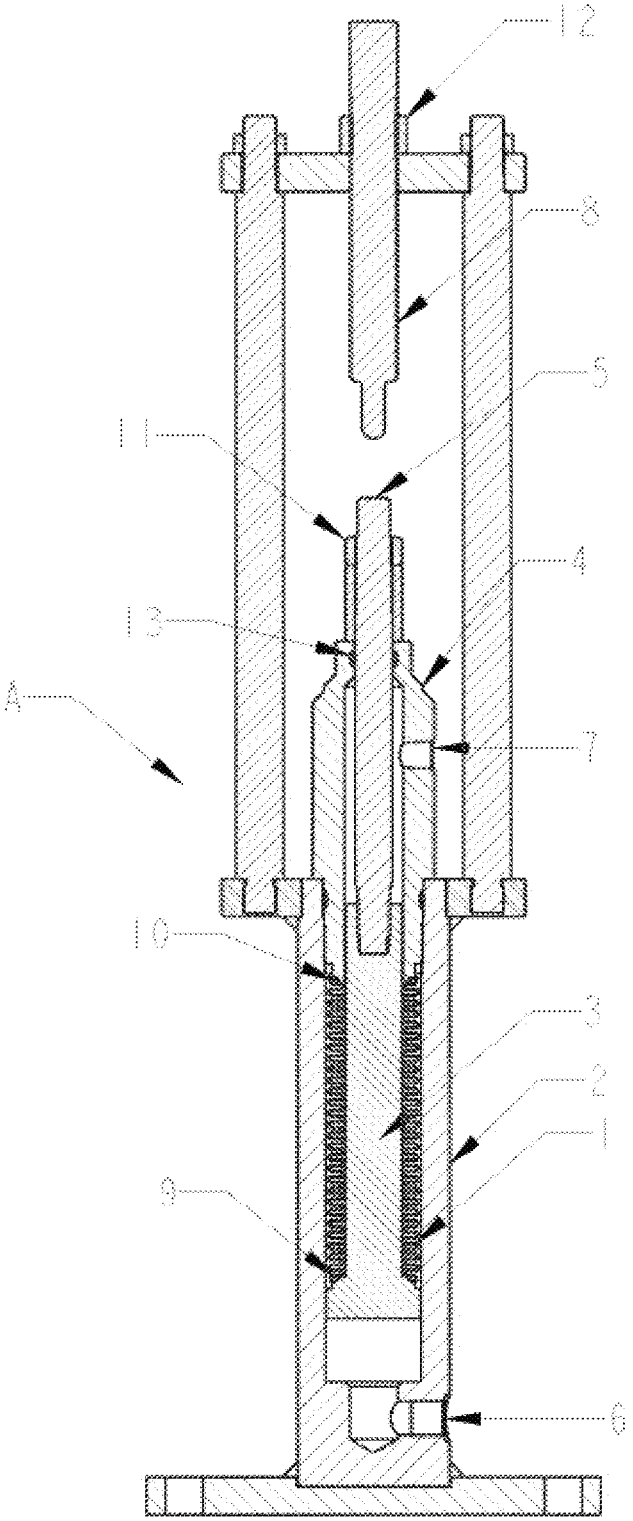
FIG. 2 shows bellow pressure crimping device/fixture used foe said crimping method
Figure 3:
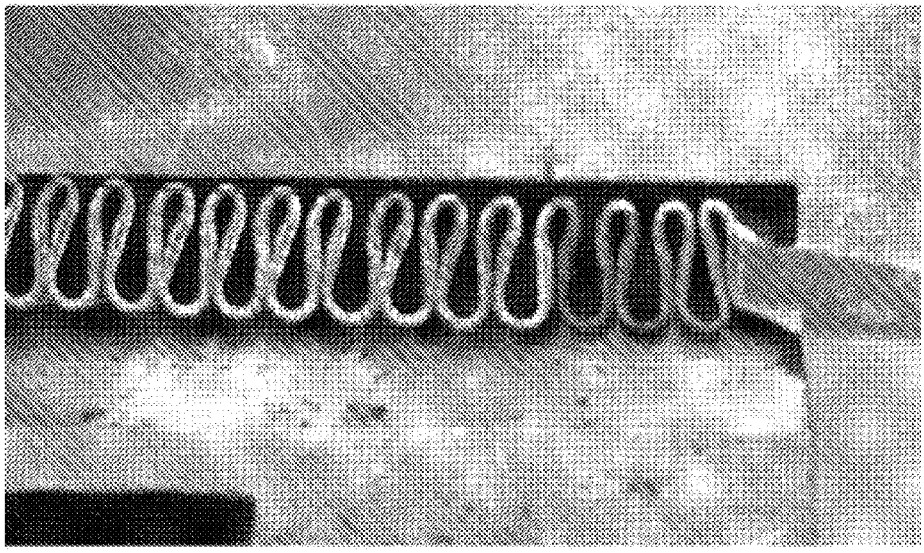
PRIOR ART FIG. 3
FIG. 3 shows bellow cross section crimped using standard/current crimping method
Figure 4:
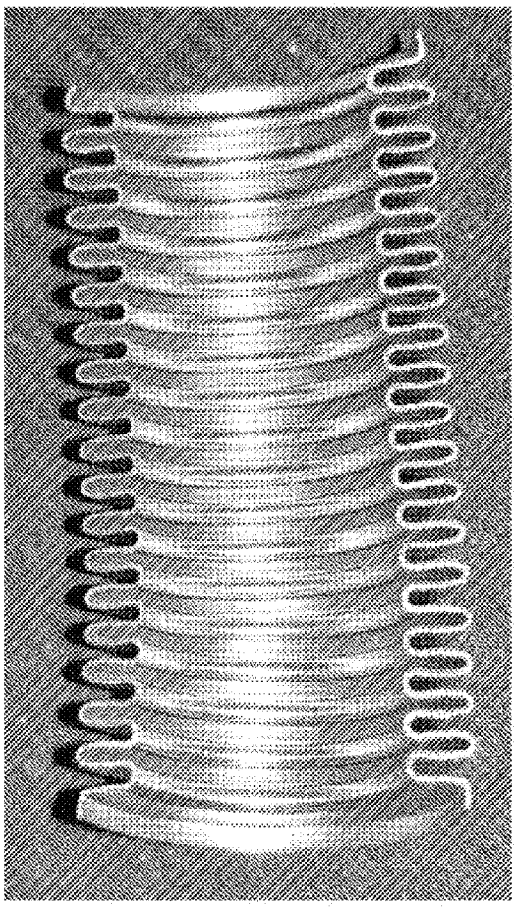
FIG. 4 shows cross section of bellow crimped mechanically
Figure 5:
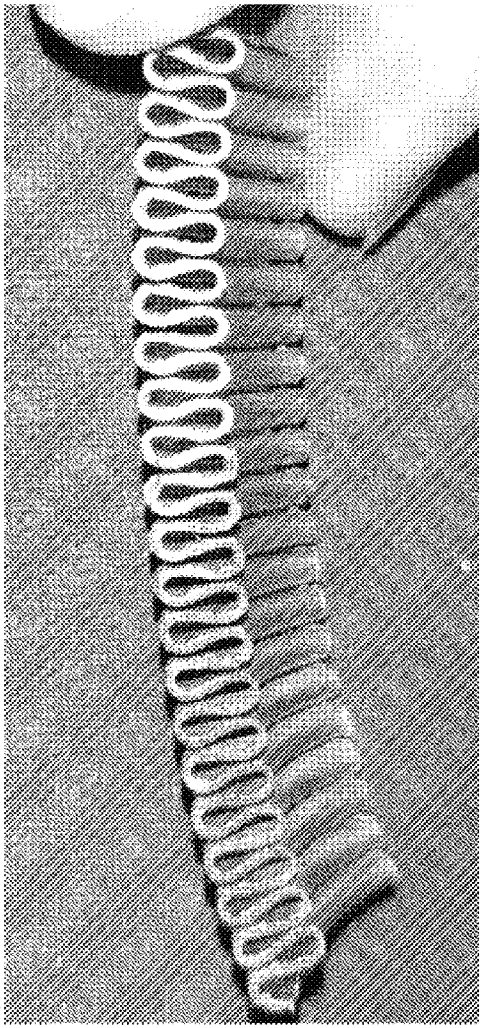
FIG. 5 shows bellow cross section having perfect Q shape using new method that is described in this patent application

Bellow crimping method described herein is performed using custom designed crimping device A, see FIG. 2.

Bellow is not welded/soldered against mating parts but in another embodiment of this device bellow can be welded/soldered against mating parts without internal stop mechanism thereby allowing free bellow compression. This would allow bellow to be properly compressed to desired length LC that depends on bellow type, size and materials used. Said bellow is installed in free length LF against mating parts, a slidable internal guide item #3 and an upper adapter item #4. Sealing between internal pressure 7 and external pressure 6 is provided by means of O-Rings item #9 and 10. A jam nut item #11 is snug tightened against a slidable rod item #5 which will engage O-Rings items #9 and 10. A travel limiter item #8 is set to appropriate height by tightening jam nut #12 thereby preventing bellow over compressing beyond length LC. Internal pressure #7 and external pressure #6 against bellow are applied simultaneously to multitude values, for example 500 PSI depending on bellow material, shape, and wall thicknesses. This does not create any differential pressure across bellow at this point. The bellow internal pressure 7 is now set to constant value, said 500 PSI, and valve that controls it is closed. All three bellow plys/layers are internally and externally supported by internal/external pressure and compressed against each other with no gap between them. Next external pressure 7 to bellow item #1 is slowly increased to desired value, for example 5000 PSI, depending on bellow type, size and material used. The Bellow is compressed until slidably rod item #5 touches travel limiter item #8 whereby O-Ring item #13 provides sealing of Internal pressure 7 inside bellow item #1. At this point bellow is compressed to length LC which will yield bellow desired as crimped length L once pressure is released and bellows springs back from length LC to said length L. Parameters LC and L are determined by experimenting. Next step is to slowly release external pressure 6 to equalize it to internal pressure 7 of said 500 PSI and then release both pressures simultaneously to atmospheric pressure. Either gas or fluid pressure can be used for this crimping process. Appropriate expansion vessel/accumulator should be used to maintain bellow internal pressure 7 at desired/constant value of said 500 PSI when bellow external pressure 6 is applied, which is not shown herein to simplify this application. Said crimping device shown on drawing #2 can be used to crimp bellows that are welded soldered against appropriate valve mating parts. In this embodiment slidable internal guide item #3 and upper adapter item #4 would be replaced by actual valve parts. Slidable internal guide item #3 provides bellow ID guide and housing item #2 provides bellow item #1 OD guide by means of tight clearances. See picture 3 that shows bellow cross section after crimping per new method described above.

Sequence Listing (See MPEP § 2424 and 37 CFR 1.821-1.825

A "Sequence Listing" is required on paper if the application discloses a nucleotide or amino acid sequence as defined in 37 CFR 1.821(a) and if the required "Sequence Listing" is not submitted as an electronic document either on compact disc or as a text file via the Office electronic filing system (EFS-Web.)

None

What is claimed is:

1. A method for bellow crimping, compressing, and shortening using a crimping device (A), wherein said method crimps, compresses, and shortens the bellow while maintaining bellow element convolution (Ω), said method comprising the following steps:

a. starting from an initial state with balanced internal pressure and external gas or fluid pressure, increasing the internal pressure and the external pressure simultaneously, to a first pressure;

b. while holding the internal pressure set to a constant value to said first pressure, compressing the bellow by increasing the external pressure to a second pressure until the bellow is compressed to a first desired length (LC), wherein differential pressure between the external and the internal pressure compress and shorten the bellow from its initial length to said first desired length (LC);

c. releasing the external pressure until it equalizes with the internal pressure;

d. releasing the internal pressure and the external pressure to atmospheric pressure, wherein the bellow partially springs back from said first desired length (LC) to a second desired length (L); thereby crimping said bellow while providing internal convolution surface support.

2. A device for crimping a substantially cylindrical bellow comprising:

a housing (2), said housing (2) having a top end and a bottom end, said housing further having an upper portion having said top end and a lower portion having said bottom end, said housing (2) configured so that its lower portion provides guiding support at the bellow's outer diameter, an external pressure port (6) disposed at said lower portion of said housing for applying external pressures, said external pressure port (6) further positioned above said bottom end, an internal pressure port (7) disposed at an upper adapter (4), for applying internal pressures, said upper adapter (4) having an upper end and a lower end and the upper adapter further having an interior portion, a slidable internal guide (3), said slidable internal guide (3) configured to provide support at the bellow's internal diameter, said slidable internal guide (3) disposed within said housing (2), said slidable internal guide (3) positioned above the external pressure port (6), a slidable rod (5), a travel limiter (8), said travel limiter having a top end and a bottom end, sealing members (9, 10, and 13), wherein said sealing member (13) is disposed near the upper end of said upper adapter (4) and around said slidable rod (5), and further wherein said sealing members (9) and (10) are positioned around said slidable internal guide (3) such that after a bellow is placed over said internal guide (3), said sealing member (9) forms a seal between one end of the bellow and the flanged end of internal guide (3), and said sealing member (10) forms a seal between the lower end of upper adapter (4) and the other end of the bellow, the bellow being a workpiece, thereby providing sealing between internal and external pressure which are applied through said external pressure port (6) and said internal pressure port (7), a first jam nut (11), is tightened against said slidable rod (5), a second jam nut (12) positioned at said top end of said housing to fix the position of said travel limiter (8), wherein said travel limiter (8) limits upward travel of slidable rod (5) through upper adapter (4), said slidable rod (5) having a top end and a bottom end, wherein said top end of said slidable rod (5) protrudes through the upper end of said upper adapter (4), with the lower end of said slidable rod (5) disposed within the interior portion of said upper adapter (4), said slidable internal guide (3) having a recessed end and a flanged end, said slidable internal guide being positioned in the housing with its flanged end toward the bottom of the housing and its recessed end toward said slidable rod (5), said slidable internal guide (3) being configured for its recessed end to engage the bottom end of said slidable rod (5), wherein starting from an initial balanced pressure state internal and external pressures are increased to a first pressure, then holding internal pressure constant, increasing external pressure to a second pressure via said external pressure port (6), thereby causing slidable internal guide (3) to move upward due to the difference between internal and external pressure, said slidable internal guide (3) therefore urging said slidable rod (5) to slide toward said travel limiter (8), thereby crimping of the bellow to a first desired length, and wherein after releasing the internal and external pressures, the bellow expands to a second desired length.

* * * * *